US007279188B2

(12) United States Patent
Arrick et al.

(10) Patent No.: US 7,279,188 B2
(45) Date of Patent: Oct. 9, 2007

(54) CAPSULE WITH FOAM CONDITIONING FEATURE

(75) Inventors: Corey Arrick, New Milford, CT (US); Ruguo Hu, New Milford, CT (US); Eugene Scoville, New Milford, CT (US)

(73) Assignee: Nestec S.A., Vevey (CH)

( * ) Notice: Subject to any disclaimer, the term of this patent is extended or adjusted under 35 U.S.C. 154(b) by 207 days.

(21) Appl. No.: 10/724,047

(22) Filed: Dec. 1, 2003

(65) Prior Publication Data

US 2005/0115415 A1 Jun. 2, 2005

(51) Int. Cl.
*B65D 81/34* (2006.01)
*A47J 31/00* (2006.01)

(52) U.S. Cl. ..... 426/115; 426/112; 426/86; 426/82; 99/295

(58) Field of Classification Search ..... 426/115, 426/112, 86, 82, 77, 433; 99/295, 302 R, 99/323

See application file for complete search history.

(56) References Cited

U.S. PATENT DOCUMENTS 5,150,645 A * 9/1992 Schiettecatte ..... 99/295
5,242,702 A 9/1993 Fond et al.
5,472,719 A 12/1995 Favre
5,897,899 A 4/1999 Fond et al.
5,913,962 A * 6/1999 Gasser et al. ..... 99/293
6,698,333 B2 * 3/2004 Halliday et al. ..... 99/295
6,832,542 B2 * 12/2004 Hu et al. ..... 99/302 R
2003/0033938 A1 2/2003 Halliday et al.
2003/0056661 A1 3/2003 Hu et al.
2004/0107841 A1 * 6/2004 Cai ..... 99/302 R

FOREIGN PATENT DOCUMENTS

EP 1243210 9/2002

* cited by examiner

*Primary Examiner*—Reginald L. Alexander
(74) *Attorney, Agent, or Firm*—Bell, Boyd & Lloyd LLP

(57) ABSTRACT

A device for preparing a whipped food, including a container portion that contains a food component and that is configured for receiving a fluid for mixing with the food component to produce a fluid mixture. A film conditioning conduit is associated with the container portion to receive the fluid mixture with gas bubbles entrained therein as a food product. The conduit includes a restriction channel associated with the container portion downstream thereof to receive the food product. The restriction channel has a cross-section sufficiently small and a length sufficiently large to selectively feed bubbles in the food product that are smaller than a preselected maximum bubble size. The conduit also includes a deceleration channel and fluid communication with the restriction channel downstream thereof to receive the food product. The deceleration channel substantially reduces the flow speed of the food product. An outlet downstream of and in fluid association with the deceleration channel dispenses the slowed food product.

5 Claims, 14 Drawing Sheets

CAPSULE WITH FOAM CONDITIONING FEATURE

FIELD OF THE INVENTION

This invention relates to a device for preparing a whipped food product, and more particularly to a device that includes a foam conditioning conduit to condition the foam in the whipped food and to a capsule that is constructed to open automatically to release the food.

BACKGROUND OF THE INVENTION

Foamed beverages, such as espresso, cappuccino and latte can be dispensed from capsules that are placed inside a beverage machine. Pre-metered and pre-packed portions of coffee and the like for the preparation of coffee-based beverages facilitate the preparation of the beverage while ensuring that the dose-to-dose quality and strength of the beverage remains constant for the same conditions of preparations (dosage, temperature, pressure, time, etc.). It also provides more convenience to the user. The capsule usually sits in a leak-tight enclosure of a special coffee machine, and hot water is passed through the capsule under pressure. The underside of the capsule is perforated under the build-up of pressure to release the extracted liquid. Some known machines use mixing devices foaming the beverages being dispensed. These devices often feed the powdered component into the water U.S. Patent Application Publication No. US 2003/0033938 discloses a cartridge for preparation of a whipped beverage. The cartridge contains one or more beverage ingredients and is formed from materials that are impermeable to air and water. An aqueous medium is introduced into the cartridge, and the beverage is forced through a restriction hole to deliver a jet of the beverage to an expansion chamber. An air inlet incorporates air into the beverage downstream of the restriction hole to provide a plurality of bubbles to the beverage at this point.

It is desirable that in certain foods, including beverages, the foaming quality and bubble size within the foam be fairly tightly controlled, to provide high quality characteristics to the food. A device is needed to provide improved foaming conditioning.

SUMMARY OF THE INVENTION

The invention relates to a device for preparing a whipped food. The device is preferably a package for a food component, but can alternatively be a device that includes an extraction chamber for receiving a package that contains the food component. The preferred device includes a container portion that contains the food component and is configured to receive a fluid for mixing with the component to produce a fluid mixture. A foam conditioning conduit is associated with a container portion to receive a fluid food product that includes the fluid mixture and gas bubbles entrained therein. The conduit includes a restriction channel and a deceleration channel. The restriction channel is preferably associated with a container portion downstream thereof to receive the food product, and is configured for conditioning the bubbles into a foam, and thus has a cross-section sufficiently small and a length sufficiently large for selectively feeding bubbles of the food product that are no larger than a preselected maximum bubble size. The deceleration channel is in fluid communication with the restriction channel downstream thereof to receive the food product. The deceleration channel is configured to substantially reduce the flow speed of the food product and deliver it to an outlet that is downstream thereof and in fluid association therewith. The slowed food product is dispensed from the outlet, such as into a cup rather receptacle or another portion of the device.

As indicated above, the preferred device comprises a package that includes a container portion and the foam conditioning conduit. The package is preferably configured for being placed in operative association with an extraction device that feeds the fluid under pressure into the container portion. The restriction channel is preferably configured to sheer the flow for producing bubbles that are smaller than the maximum size and foaming the food product to produce foam therein.

The deceleration channel is preferably configured for retaining the conditioning of the foam that was produced in the restriction channel. Preferably, the deceleration channel substantially reduces or prevents the rupturing of the bubbles flowing therethrough. The deceleration channel is preferably configured for substantially retaining the individual bubble-mass below this maximum as received from the restriction channel.

The preferred maximum bubble size corresponds to a maximum bubble mass of each bubble in the foam. The deceleration channel is also preferably configured to slow the flow sufficiently for dispensing the food product from the outlet of the speed that is sufficiently low to substantially retain the conditioning of the foam in the food product. More preferably, the deceleration channel is configured to slow the flow sufficiently for dispensing from the outlet at a speed that is low enough to substantially reduce or prevent the substantial rupturing of the bubbles during dispensing.

The gas that forms the bubbles is preferably contained in the container portion. The container portion itself is preferably configured for receiving an injection of the fluid in mixing the gas as bubbles into the mixture of the food component and the fluid to deliver the food product to the conditioning conduit. In the preferred embodiment, the gas is preferably introduced into the foam conditioning conduit upstream of the restriction channel. Preferably, at least about 75% of the gas of the food product that is dispensed through the outlet is fed through the restriction channel, and more preferably substantially all of the gas that is dispensed in the foam is fed through the restriction channel. The foam conditioning conduit is most preferably free of any inlet downstream of the restriction channel.

The preferred restriction channel has a cross-sectional area between 0.01 and 3 $mm^2$. The deceleration channel preferably has a cumulative cross-sectional area connected to the outlet of between 0.05 $mm^2$ and 100 $mm^2$. The preferred length of the restriction channel or any of its sub-channels is at least about 20 times the largest cross-sectional dimension thereof. The preferred length of the restriction channel is between about 5 mm and 50 mm.

The preferred deceleration channel is configured for reducing the flow speed of the food product exiting the restriction channel to between 1:5 and 1:100 of the speed at which the flow exits the restriction channel into the deceleration channel, or of the maximum speed in the restriction channel, depending on the embodiment. The preferred deceleration channel has a cross-section with an aspect ratio of between about 1:5 and 1:50, such as the ratio of width to depth, with the depth being oriented preferably axially with respect to the outlets, and the width preferably measured on a plane that extends radially with respect to the outlets, which is also preferably the plane in which the flow conditioning conduit is principally oriented. The deceleration channel can comprise a plurality of deceleration sub-channels that have a cumulative cross-sectional area that is sufficiently larger than the cross-sectional area of the restriction channel to sufficiently and substantially decelerate the flow to the desired dispensing flow speed.

The preferred embodiment has a closure, such as a lid, associated with a container portion for enclosing the food product therein. The foam conditioning conduit extends through the closure in this environment. This is preferably the case where the foam conditioning conduit is part of the package that also includes the enclosure. In one embodiment, the closure can include at least two portions between which the channels of the foam conditioning conduit are defined. A first one of the walls can define one or more grooves and a second one of the walls can compress a foil that is sealed to the first wall for cooperatively defining at least a portion of the channels therebetween. The closure includes a seal that seals the foam conditioning conduit from the food component and the container portion. The device can further include an opening mechanism that is operatively associated with the seal for opening the seal in response to an elevated fluid pressure within the container portion for fluidly communicating the container portion with the conditioning conduit for feeding the fluid mixture into the conduit. The preferred opening mechanism is integral and the recharge of the preferred embodiment, and preferably includes a piercing member that is disposed with respect to the seal such that when the pressure reaches a predetermined value inside the container portion, the seal and the piercing member are biased into a piercing association. In this piercing association, the piercing member pierces the seal to fluidly communicate the container portion with the conditioning conduit.

One embodiment includes an opening mechanism, and may include or exclude the foam conditioning channel. In this embodiment, the opening mechanism may open directly to one or more outlets for allowing the mixed fluid and food product, and potentially entrained bubbles, to be dispensed, such as directly into a receptacle for a consumption.

In a preferred method, the fluid, for example water, is injected at high pressure into the container portion for mixing with the food component and the gas to provide a food product. The food product is fed from the container portion under pressure through the restriction channel to feed therethrough the bubbles in the food product substantially only that are smaller than the predetermined maximum bubble size for conditioning the foam and the food product. The food product is fed from the restriction channel through the deceleration channel to substantially reduce the flow speed thereof, while protecting the bubble composition. The food product is dispensed at a speed that is sufficiently low to substantially reduce or prevent splashing to substantially retain the conditioning of the foam. The preferred food product is a beverage. Some of the preferred food products include coffee, tea, milk, and soup products.

The invention provides a device for conditioning a high quality foam in an economical and convenient manner.

DETAILED DESCRIPTION OF THE PREFERRED EMBODIMENTS

Figure 1:
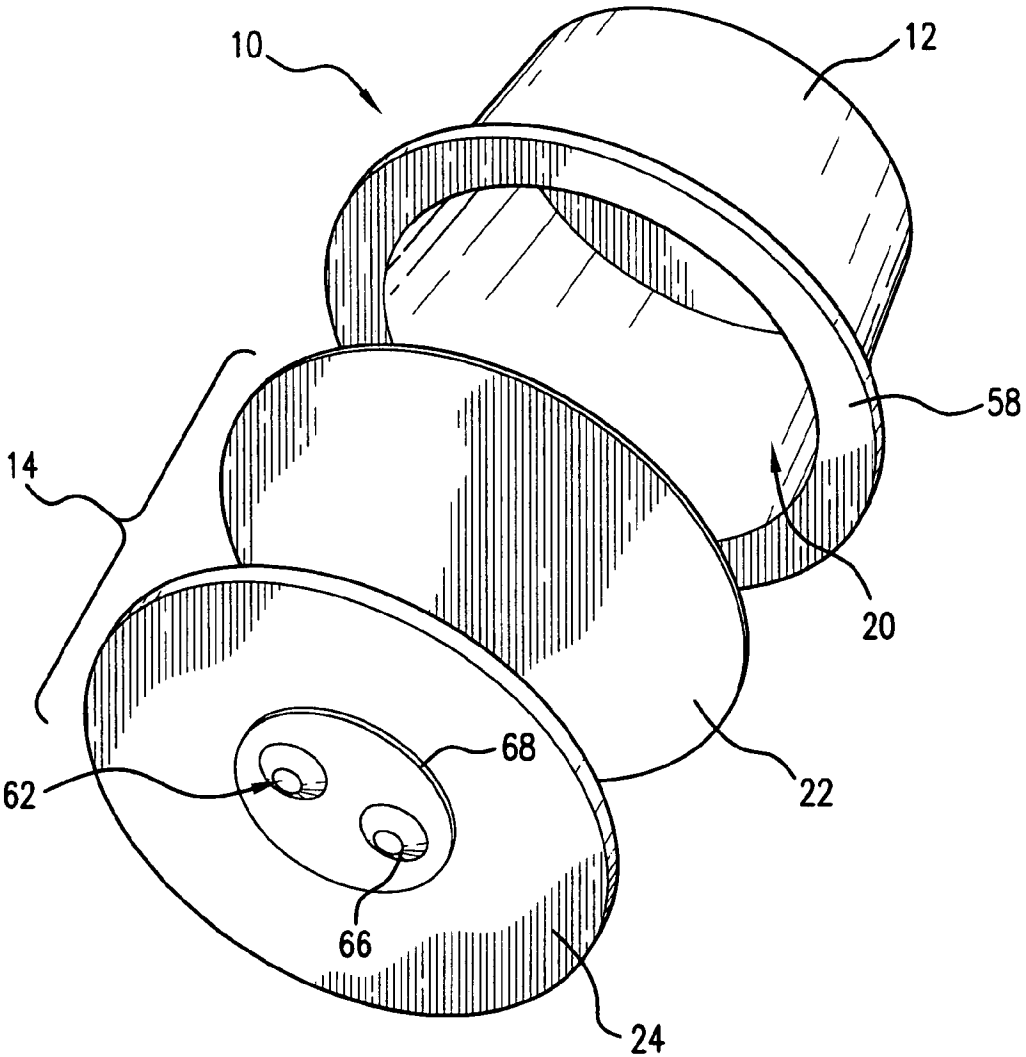
FIGS. 1 and 2 are bottom and top exploded perspective views of a preferred embodiment of a capsule constructed according to the present invention.
Figure 2:
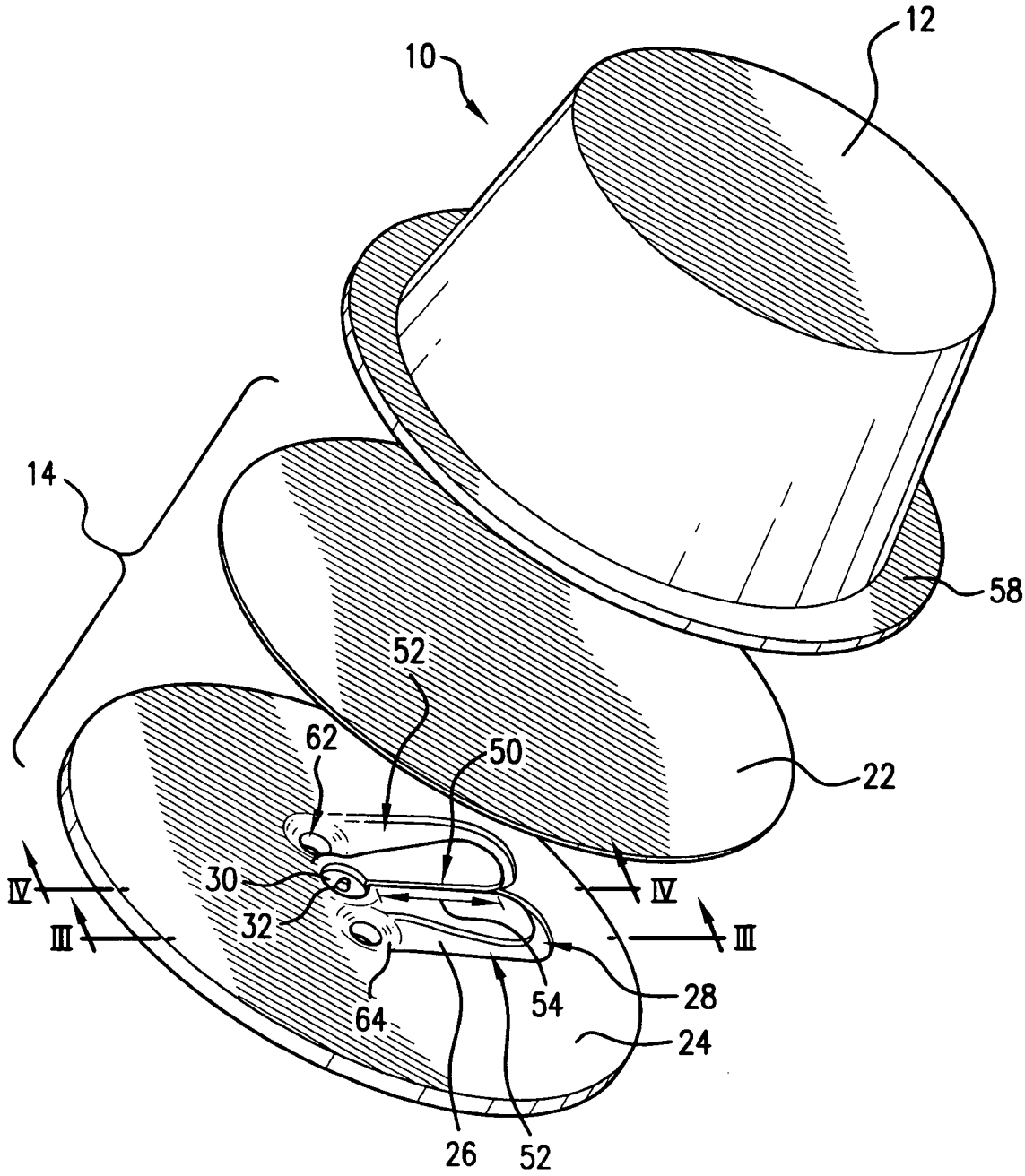
Figure 3:
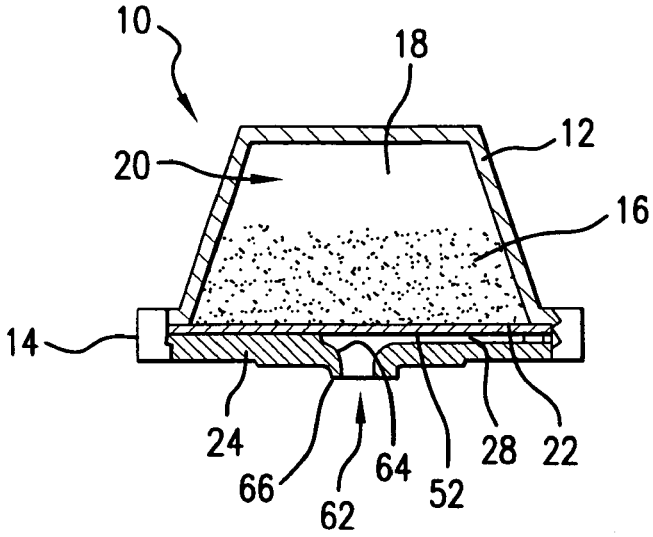
FIG. 3 is a lateral cross-sectional view thereof taken along plane III-III of FIG. 2.

Referring to FIGS. 1-3, a preferred embodiment of a package constructed according to the invention is a capsule 10. Capsule 10 includes a container portion 12 to which a closure, such as a lid 14, is preferably attached and sealed. A food component 16 and also air 18 is contained within the interior cavity 20 of the container portion 12 and retained in therein by the lid 14, which preferably seals the interior cavity 20.

The dose of food component 16 is preferably selected to provide a single serving of the food product to be produced. For instance, a coffee or tea capsule would have enough for a cup of the beverage, whereas a soup capsule would have enough for a cup of a soup bowl. Other embodiments can have two or more doses.

The lid 14 of the preferred embodiment includes a foil 22 and a channel wall 24. Foil 22 is preferably sealed to both the container portion 12 and the channel wall 24. The seal between the foil 22 and the container portion 12 is sufficient to retain the seal upon pressurization of the interior cavity 20 when a fluid, such as water is injected under pressure as described below. Suitable techniques for sealing the foil 22, the channel wall 24, and the container portion 12 include heat sealing, pressure sealing, welding, adhesion, and crimping. In a preferred construction of the capsule 10, the container portion 12 has a cup shape with a peripheral edge 58 that extends outwardly with respect a sidewall 60 to form a connection surface for sealing with the lid 14.

Wall 24 defines groves 26, which in this embodiment are open in a direction facing the foil 22. The foil 22, in turn, is sealed to the wall 24 to close the open side of the grooves 26 to provide a foam conditioning conduit 28 between the foil 2 and the wall 24. The foil 22 blocks and preferably seals the contents of the interior cavity 20 from the conduit 28. In another embodiment, the foil 22 can be replaced with a rigid or semirigid wall. In yet another embodiment, the wall 24 can be replaced with another foil that is sealed to the foil 22 in selected areas to provide the foam conditioning conduit between the two foils along an unsealed area between the foils.

Figure 4:
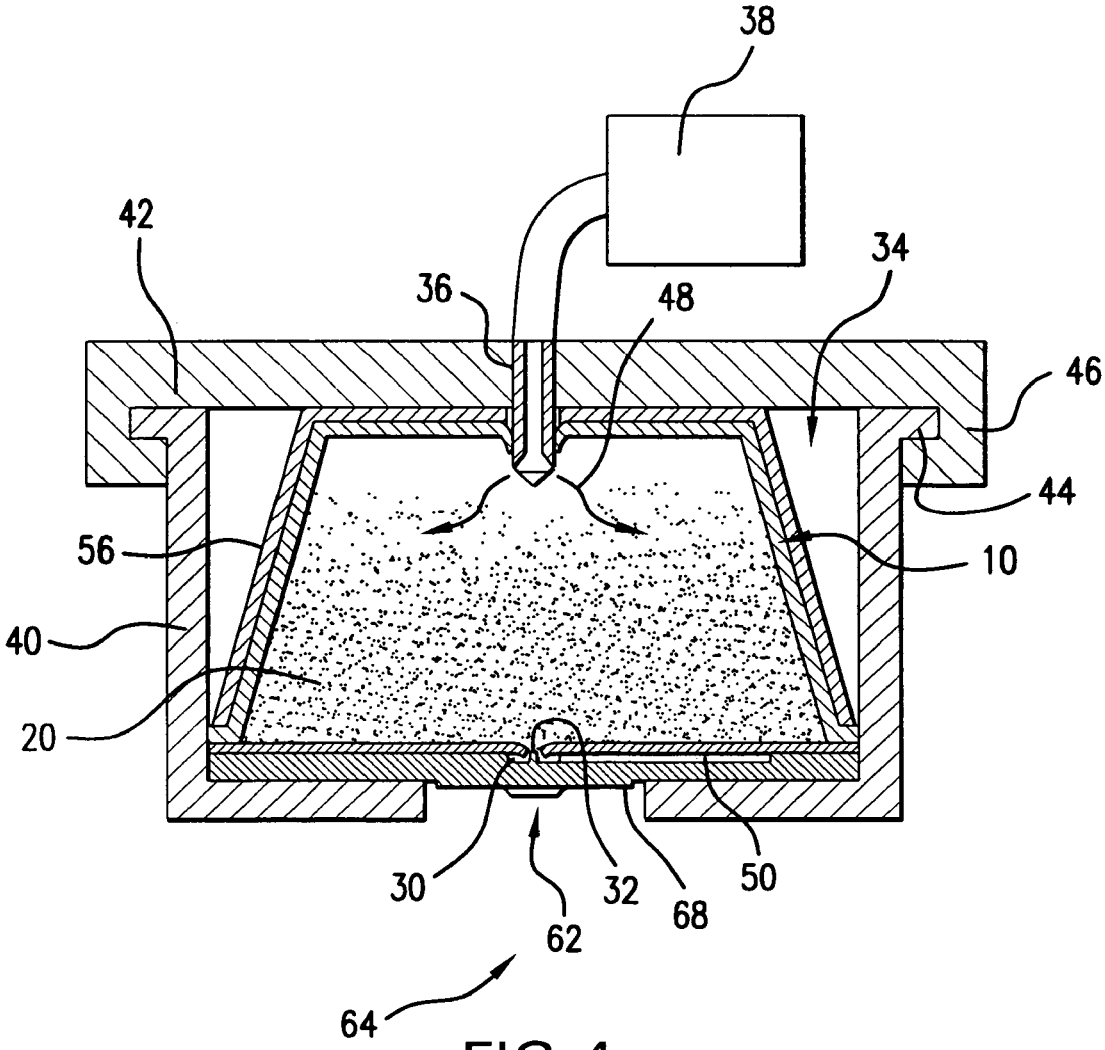
FIG. 4 is a cross-sectional view thereof during fluid injection in an extraction chamber, with the cross-section taken along plane IV-IV of FIG. 2.

As shown in FIG. 4, the capsule 10 is configured to be received within an extraction chamber 34. The extraction chamber 34 is preferably configured to hold the capsule 10 and associate the capsule 10 with a fluid injection system. A preferred injection comprises a needle 36 or other device to open and inject a fluid into the capsule 10. The needle 36 is fluidly communicated with a fluid source, such as a hot water source 38. The capsule 10 is shown received in a lower portion 40 of the extraction chamber 34. The lower portion 40 is detachably attached to an upper portion 42 of the extraction chamber 34, and can be connected therewith with a bayonet fitting 44 that is associated with a ramp 46 so the upper and lower portions 40,42 can be quickly connected or disconnected. The connection system between the lower and upper portions may encompass a large number of variants, such as a jaw mechanism operated by a lever.

When the upper and lower portions 40,42 are attached, the needle 36 pierces the container portion 12 of the capsule 10, opening the capsule 10. In the preferred embodiment, hot water 48 is then injected through the needle 36 into the interior cavity 20, which mixes with the food component 16 and air 18 therein, producing a fluid, and preferably liquid, food product with entrained bubbles. The speed of the injection is sufficient adequately, and preferably thoroughly, mix the food component 16 with the water 48, and the turbulence of the flow traps the bubbles of air. The water injection also increases the pressure within the interior cavity 20.

The capsule 10 preferably serves as a mixing bowl for the food component, which is preferably a powder that has foaming capacity, to reconstitute a liquid beverage by thorough mixing with the fluid diluent. The fluid, as mentioned, can be water, and can also be milk or another fluid. The interior cavity 29 is preferably has a volume from 20 to 100 $cm^3$, while 25 to 45 $cm^3$ is more preferred. The interior cavity 29 preferably contains a suitable amount of gas such as air, $O_2$, $CO_2$, $N_2$ or any other inert gas or combinations thereof. Preferably, the ratio powder volume to gas volume ranges of from 1:50 to 10:1. Preferably, for soluble coffee, the ratio powder volume to gas volume is preferably comprised of from 1:50 to 1:5, and more preferably 1:30 to 1:10. For soluble high-load powder that includes milk powder, such as chocolate, cappuccino, or soup, the ratio powder volume to gas volume is preferably 1:2 to 4:1. Ratios can be tailored as desired for these and other beverages, such as tea, to produce entrap sufficient gas within the interior cavity 20 such that upon release at normal atmosphere the beverage includes multiple fine bubbles that confer an enhanced head of foam in the cup. More head space, i.e., a lower powder to air volume ratio, allows better initial powder dissolution, especially for powders with lower solubility and/or that generate a viscous mass after it mixing with water.

The conduit 28 of the capsule includes a entrance region 30 with a conduit opening mechanism that includes a foil-piercing member 32 that protrudes from wall 24 toward the foil 22. The entrance region 30 has a sufficiently large cross-section and is sufficiently deep to allow the foil 22 to deform into the entrance portion 30 when the interior cavity 20 is pressurized by the water injection as the pressure from the water biases the foil 22 against the piercing member 32. As shown in FIG. 4, the pierced foil 22 opens a fluid pathway for the fluid food product with entrained bubbles to the conduit 28.

The container portion 12 and the conduit opening mechanism, which includes the foil 22 and the foil-piercing member 32, are preferably configured to withstand a pressure of at least 2 bars. This can be aided by a close fitting capsule support 56, shown in FIG. 4, but the capsule 10 is preferably configured to withstand this pressure without exterior support to the container portion 12. This elevated pressure produces an high quality crema/foam in certain beverages, such as coffee and milk type products.

As shown in FIG. 2, the conduit 28 includes a restriction channel 50, which is in fluid association with the interior cavity 20 and downstream thereof when the foil 22 is punctured by the piercing member 32. The restriction channel receives the fluid food product and entrained bubbles from the entrance region 30. Prior to entering the restriction channel 50, the bubbles have a broad range of sizes. The restriction channel 50 has a cross-section perpendicular to the flow that is sufficiently small and configured to control the size of the bubbles that pass therethrough to be below a maximum threshold size. Preferably, the restriction channel is configured to reduce the average bubble size and preferably to substantially reduce or eliminate bubbles larger than a maximum threshold size. The restriction channel can control the bubble size such that the channel outlets predominantly bubbles smaller than the threshold maximum size, and most preferably substantially all of the bubbles are smaller than the threshold size.

The preferred cross-sectional area of the restriction channel 50 is between about 0.01 $mm^2$ and 1 $mm^2$, and in some embodiments can be as high as 3 $mm^2$. For making coffee products, the restriction channel 50 has a cross-sectional area that is preferably greater than about 0.1 $mm^2$, and more preferably at least 0.16 $mm^2$, and preferably less than about 0.4 $mm^2$, more preferably at most 0.36 $mm^2$. For milk products, such as cappuccino, the cross-sectional area is preferably greater than about 0.2 $mm^2$, and more preferably at least 0.25 $mm^2$, and preferably less than about 3 $mm^2$, more preferably at most 2.25 $mm^2$ Larger bubbles preferably are broken up into smaller bubbles when they are forced through the restriction channel. To accomplish this, the restriction channel 50 must also be long enough so that the narrow cross-sectional restriction will sufficiently shear the flow to reduce the bubble size as desired. The preferred length 54 of the restriction channel 50 is at least about 15 times the length of largest cross-sectional dimension at the narrow portion of the restriction channel 50, and more preferably at least about 20 times. Preferably, the restriction channel 50 maintains the preferred small cross-sections for substantially this entire length, and in the preferred embodiments, the cross-sectional area of the restriction channel remains substantially unchanged along its length. In one embodiment, the average cross-sectional area of the restriction channel 50 remains in the preferred ranges along this length. An embodiment of the restriction channel 50 has a maximum cross-sectional width of around 0.1 mm, with a restriction channel length of about 20 mm. Another embodiment has a restriction channel 50 that up to 40 to 50 times the cross-sectional width thereof. These preferred lengths can alternatively be measured in relation to the square root of the cross-sectional restriction channel area.

Additionally, in some embodiments, the restriction channel 50 can comprise a plurality of sub-channels connected in parallel or that split off downstream of the interior cavity 20. Where multiple sub-channels are present that do not flow in series, the preferred cumulative length of the restriction channel 50 can be measured in relation to the maximum widths the largest of the sub-channels. Preferably the preferred ratios of length to width are kept within each sub-channel. One embodiment, has a restriction channel with 3 sub-channels, each up to about 15 mm long and more preferably between 8 mm and 10 mm long. This embodiment thus has a restriction channel length of up to 45 mm. As the preferred cross-sectional maximum width is around 1 mm, resulting in a cumulative restriction channel length of 45 times the sub-channel width. The preferred length of the sub-channels is 5 mm and 15, and in some embodiments the cumulative sub-channel length of the restriction channel is preferably up to about 50 mm.

The mass of the bubbles can be referred to as being reduced, as the diameter and volume of the bubbles can change significantly in the different portions different portions of the conduit 28 as the pressures change from region to region therein. Thus, the large mass bubbles that reach the entrance of the restriction channel 50 due to the turbulent flow within the interior cavity 20 are either filtered from entering the restriction channel 50 or are broken into smaller mass bubbles by the restriction channel 50, such that only bubbles smaller than a preselected mass will exit the restriction channel 50.

Downstream of in fluid communication with the restriction channel 50 is a deceleration channel 52. Preferably, the restriction and deceleration channels 50,52 extend primarily substantially and generally parallel to the surface of the lid, which can thus more easily be formed as a disk. In the preferred embodiments, no additional gas or air is fed into the conditioning conduit 28 downstream or in the restriction channel 50, especially in any manner that can alter or increase the bubble mass size that exits the restriction channel 50. Preferably, at least about 75% of the gas that is dispensed through the outlet is fed through the restriction channel, and most preferably substantially all of the gas is introduced into the foam conditioning conduit upstream of the restriction channel.

The deceleration channel 52 receives the flow of food product and entrained bubbles from the restriction channel 50 and is configured to decelerate this flow. The deceleration channel 52 preferable is configured to decelerate the flow sufficiently smoothly to protect the structure of the bubbles. The deceleration can be gradual to protect the bubble structure. If the deceleration is not smooth or too much turbulence is produced in the deceleration channel 52, the small bubble mass size achieved in the restriction channel 50 can be compromised as small bubbles are forced to combine with each other to form larger bubbles.

The deceleration channel 52 is preferably configured for reducing the speed of the flow exiting the restriction channel to a decelerated speed preferably of at most about 1:5, more preferably at most 1:10, and most preferably at most about 1:20 of the restriction channel speed, and preferably at least about 1:100, more preferably at least about 1:50, and most preferably at least about 1:30. Typical flow velocities in the restriction channel 50 and entering the deceleration channel 52 are preferably between about 1-5 m/s and more preferably about 1-4 m/s for a flow of about 3-10 ml/s. One embodiment has a flow speed entering the deceleration channel of around 2.4 for around a 6 ml/s flow. The flow is preferably slowed by the end of the deceleration channel 52 to be dispensed into a cup or other container at a flow speed of around 0.01 m/s, with a preferred range of around from 0.005 to 0.02.

The deceleration channel 52 can also include a plurality of sub-channels, such as the two shown in FIG. 2, which split off from the restriction channel 50. The cross-sectional area of the deceleration channel 52 or any of its sub-channels preferably has a cross-sectional area that is enlarged compared to the cross-sectional area of the restriction channel 50 to obtain this speed reduction. The preferred cumulative cross-sectional area at exit or exits of the deceleration channel 52 or its sub-channels is preferably at least about 0.05 $mm^2$, more preferably at least about 3 $mm^2$, and most preferably at least about 5 $mm^2$, and preferably at most about 100 $mm^2$, more preferably at most around 40 $mm^2$, and most preferably at most around 30 $mm^2$. One embodiment has a single deceleration channel that is 0.5 mm deep and 10 mm wide at its largest cross-section at its exit, with a cross-section thereat of 5 $mm^2$. Another embodiment has three sub-channels of the deceleration channel, each with a depth of 1 mm, and a width of 10 mm, thus each sub-channel having a cross-section of 5 $mm^2$, and the deceleration channel having a cumulative cross-section of 30 $mm^2$.

The deceleration channel 52 has a length that is preferably sufficient to aid in the gradual speed reduction of the flow to help retain the small bubble size depending on the configuration of thereof. The preferred sub-channels of the deceleration channel has a depths to width ration of at most about 1:5, more preferably at most about 1:10, and at least about 1:50 and more preferably at least about 1:30. Making the height smaller allows the wall 24 of the capsule lid to be thinner, but care should be taken in the selection of the materials, for instance of the foil 22, to keep the channel 52 from collapsing under increased pressures within the internal cavity 20. The preferred channel depth is less than about 1 mm to reduce manufacturing costs.

The increase in cross-sectional area along the length of the deceleration channel 52 or sub-channels is preferably gradual and occurs preferably over at least about ¼ of its length, more preferably along at least about ⅓ of its length to most or substantially all of its length. This gradual increase is preferably configured to reduce or avoid a pulsation of the flow, although certain configurations of a sudden expansion of the deceleration channel are feasible.

As shown in FIGS. 1 and 2, the deceleration channel 52 empties through an outlet 62. The transition from the deceleration channel 52 to the outlet 62 is preferably also smooth to preserve the small bubble size in the flow, such that a crema/foam with a fine and even bubble size is dispensed. As shown in FIGS. 2 and 3, a smooth curved lower surface 64 is preferably provided to dispense the food product through the outlet 62. The deceleration channel 52 is configured to slow the flow sufficiently to avoid discharging the fluid food product from the outlets 62 as a high speed jet that would likely splash in the receptacle into which it is emptied, which would cause the bubbles structure to be disturbed and the bubble size to increase and become more irregular. The preferred exit speed of the flow is between about 1 and 5 m/s, and more preferably around 3 m/s to avoid splashing and creation of larger bubbles.

On the outside of the capsule 10, a sharp edged nozzle 66 can be provided around the outlet 62 so the flow exits the outlet substantially without clinging to the outside surface. The interior surface of the outlet is preferably disposed at an angle of more than 90°, and preferably more than about 120°, from the exterior of the nozzle 66.

Figure 5:
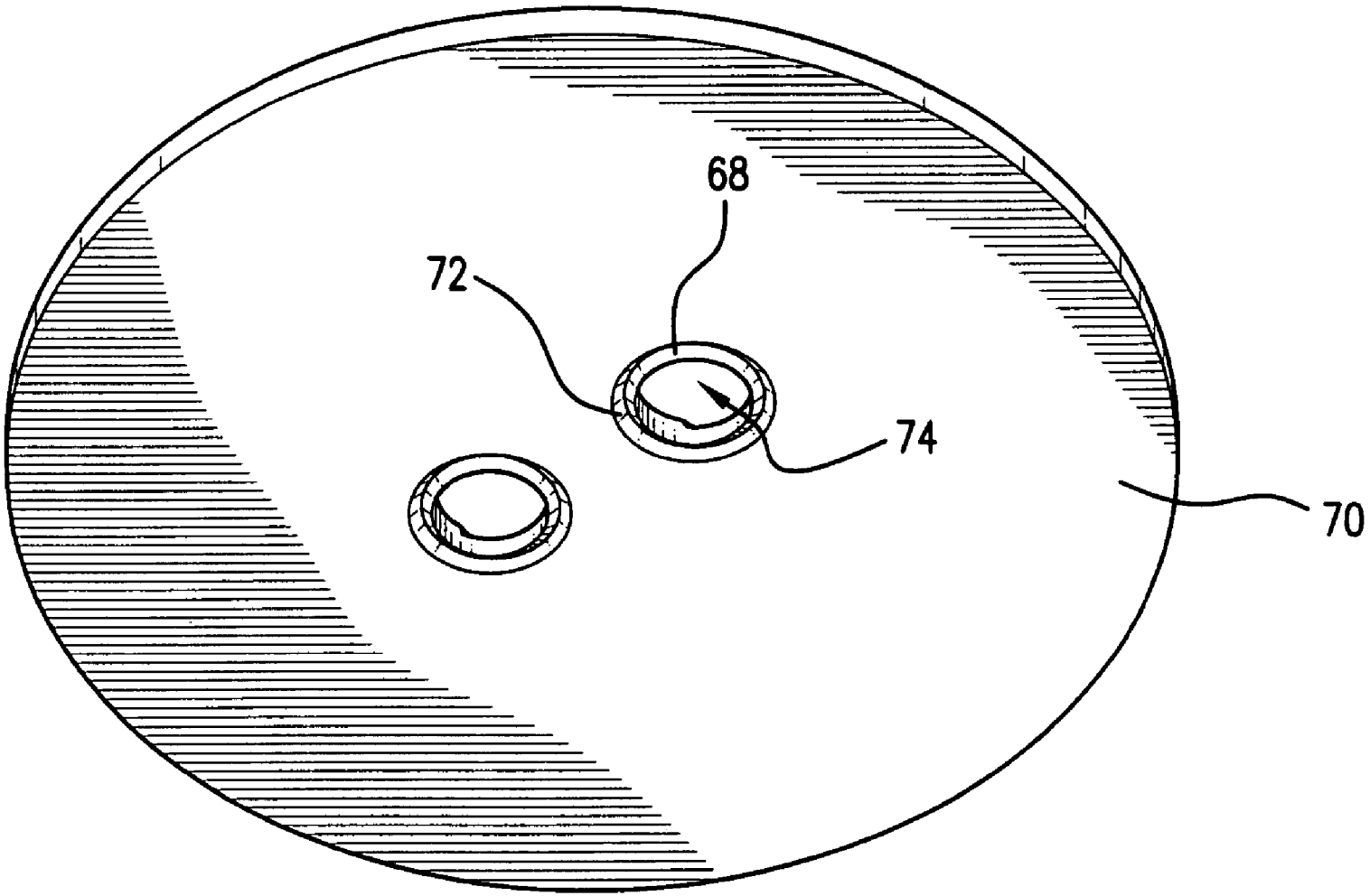
FIG. 5 is a bottom perspective view of an alternative embodiment of a capsule lid.
Figure 6:
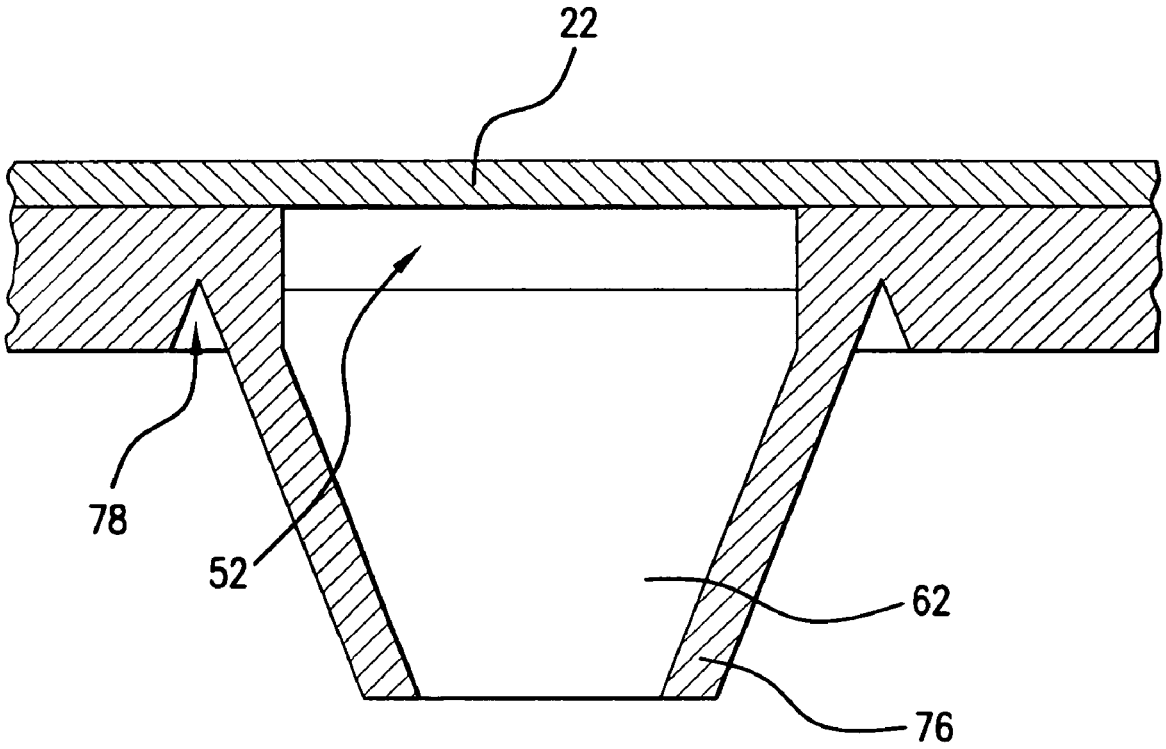
FIG. 6 is a cross-sectional view of another embodiment of an outlet nozzle of a capsule.

Additionally, the bottom exterior surface of the lid 14 can be provided with a ledge 68 or other feature to help align the capsule 10 with the lower portion 40 of the extraction chamber. In a dispensing machine that includes the extraction chamber of FIG. 4, a dispensing area 64 can be provided to place a cup under the outlet 62. An embodiment with nozzles 68 that are recessed in the outer surface of a lid 70 is shown in FIG. 5, a groove 72 being provided about the outlets 74 to provide the nozzles 68. FIG. 6 shows an embodiment with a nozzle 76 that protrudes from the bottom lid surface and also has a groove 78 extending around the base of the nozzle 76.

Figure 7:
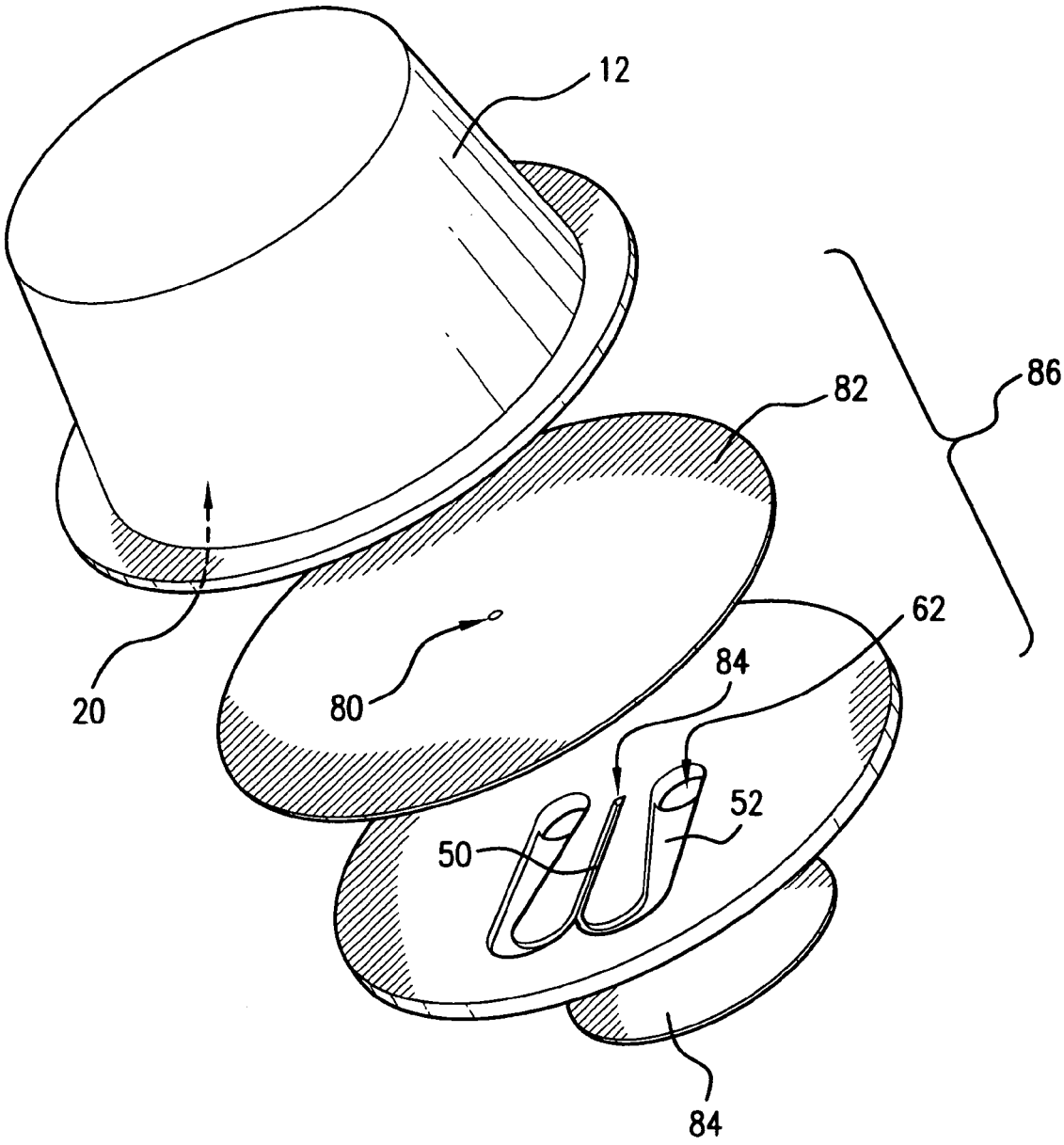
FIG. 7 is an exploded perspective top view of another embodiment of a capsule.

Referring to FIG. 7, an embodiment is shown without a conduit opening mechanism. Instead, an opening 80 in foil 82 is aligned with an entrance portion 84 of the restriction channel 50. Another foil 84 can be sealed over the outlets 62 on the exterior side of the lid 86 to seal the interior cavity of the container portion 12. The foil 84 can be punctured, for example, by a raised portion in the extraction chamber, or can be opened by other means, such as by bursting or breaking its seal in response to an increased pressure within the interior chamber 20.

Figure 8:
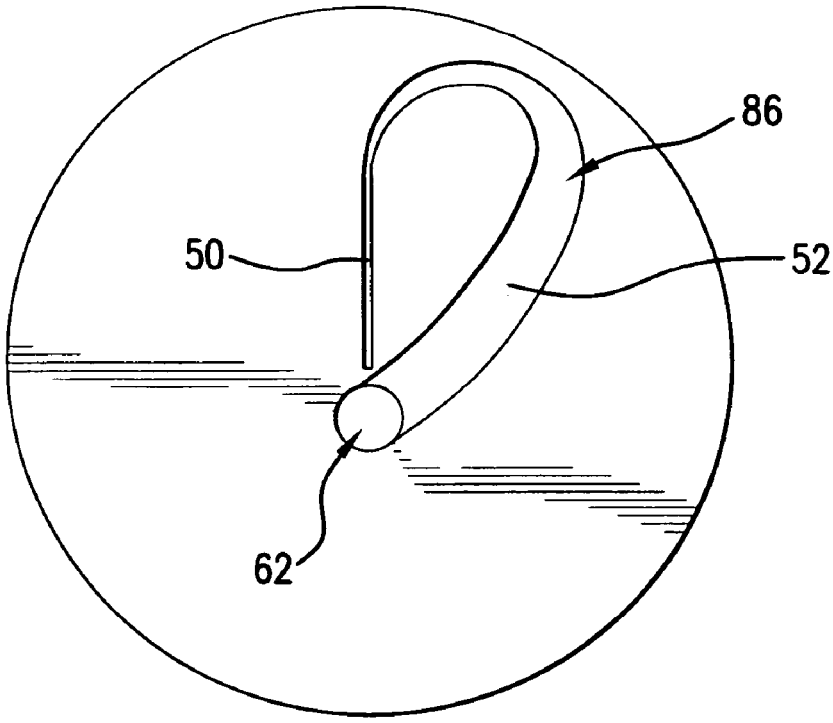
FIGS. 8-11 are top views of several embodiments of foam conditioning conduits constructed.
Figure 9:
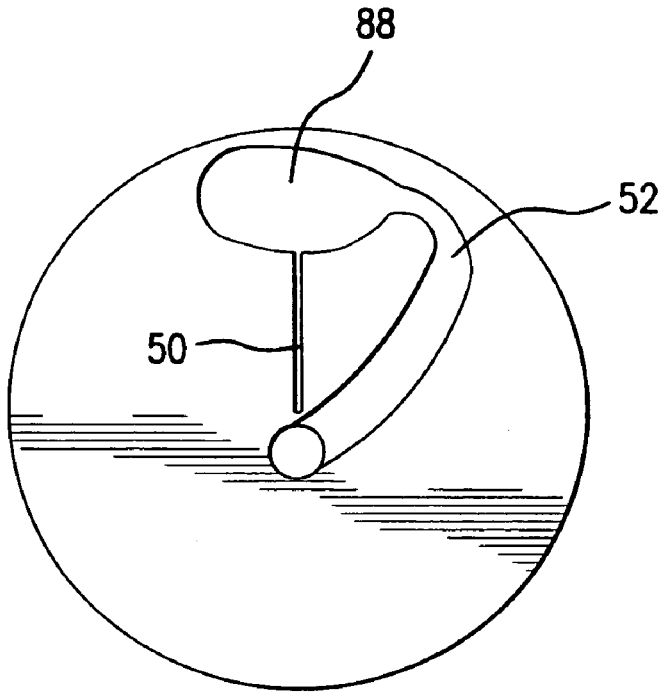
Figure 10:
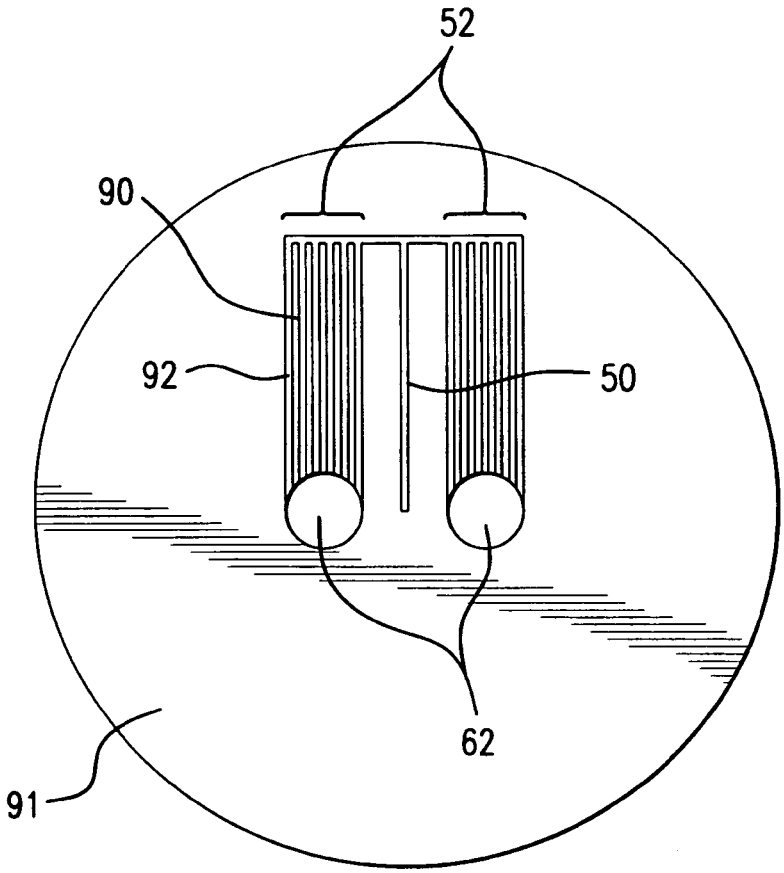
Figure 11:
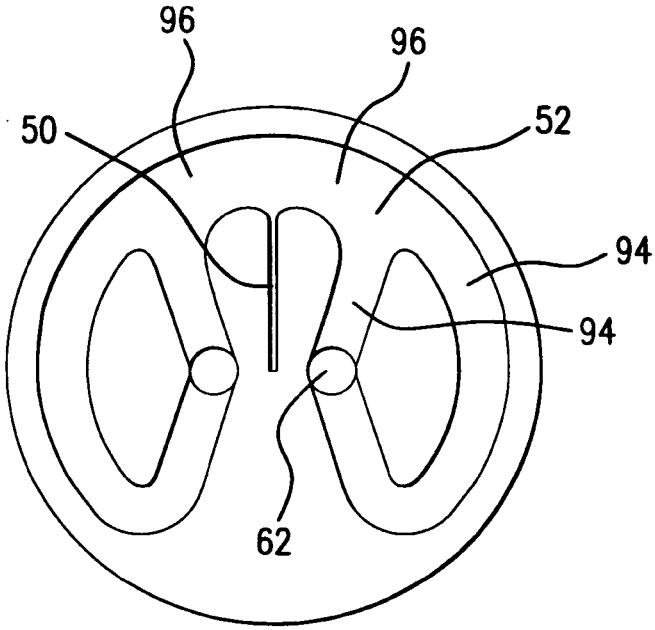
Figure 12:
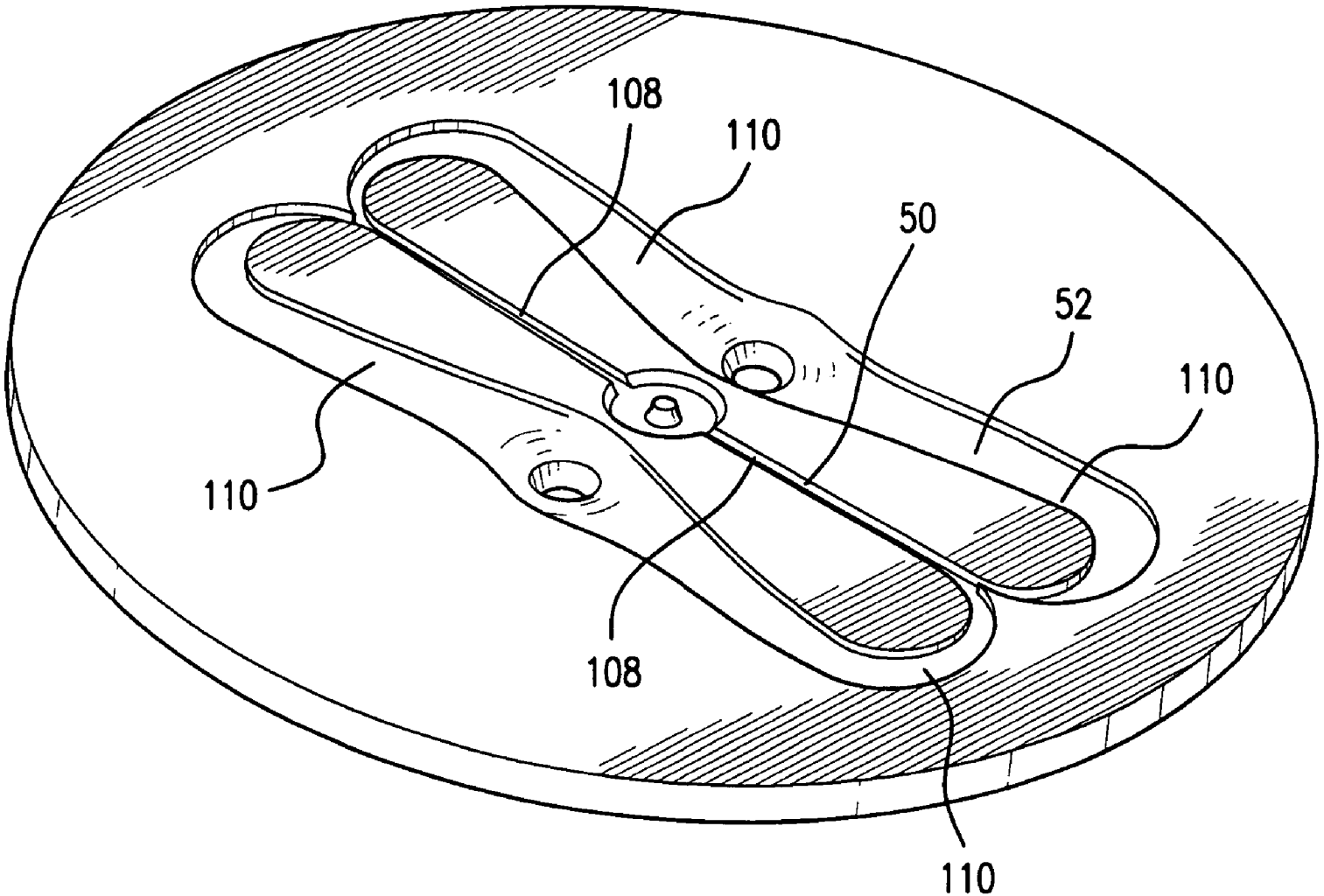
FIGS. 12 and 13 are top perspective views of other embodiments of foam conditioning conduits.
Figure 13:
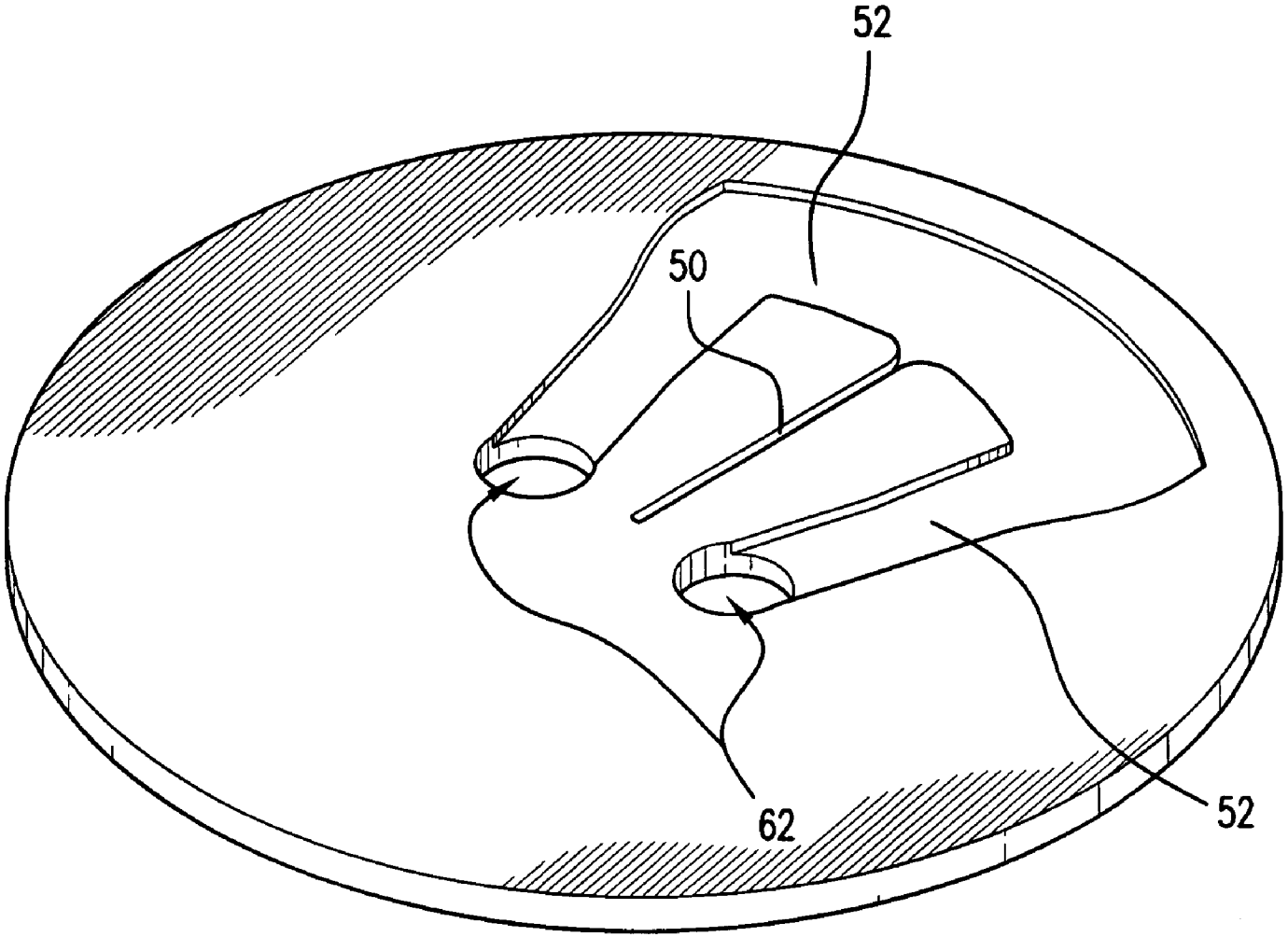
Figure 14:
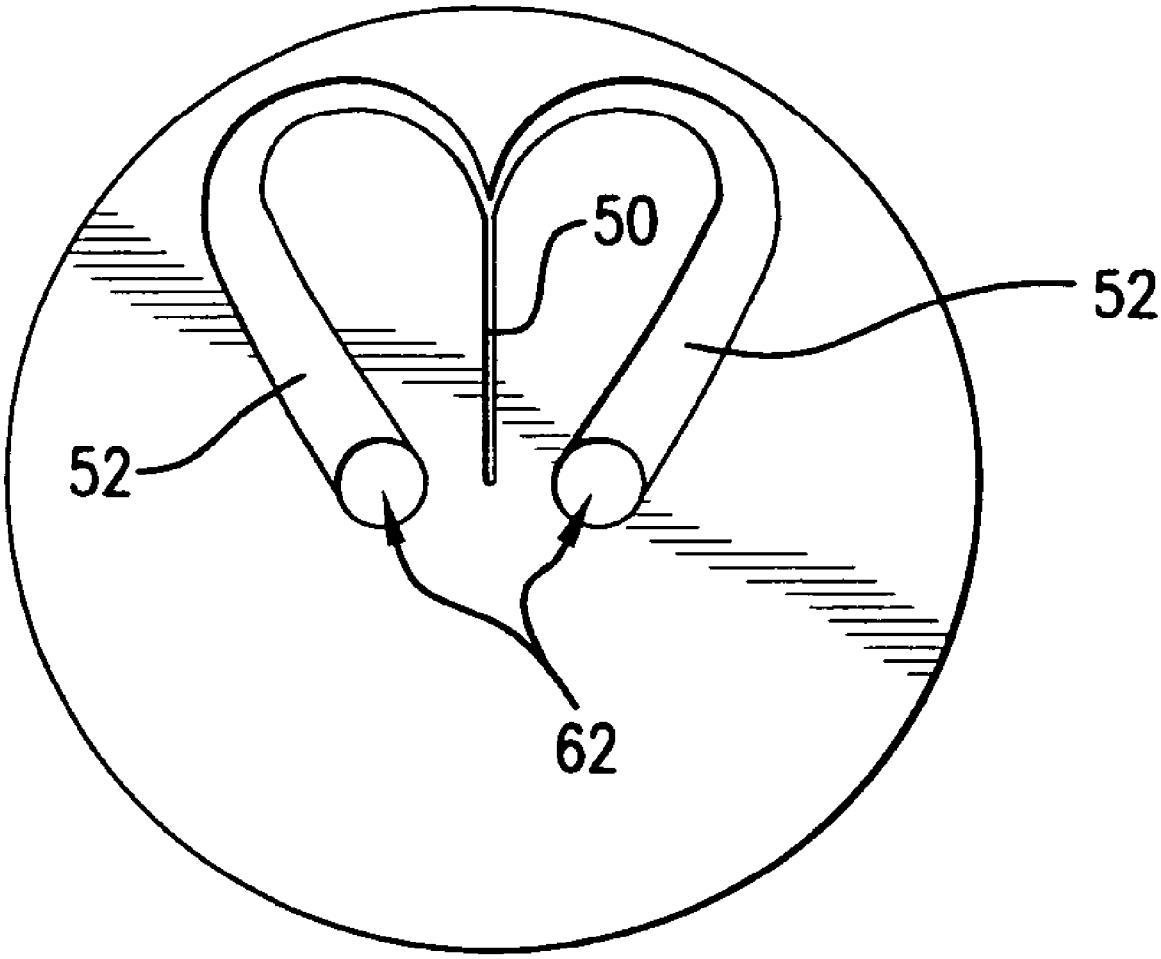
FIG. 14 is a top view of another embodiment of a foam conditioning conduit.

FIG. 8 shows an embodiment of the shape of the foam conditioning conduit 86 with a deceleration channel 52 that comprises only a single channel, and no additional sub-channels. Although the cross-section of the deceleration channel 52 preferably increases smoothly, the embodiment of FIG. 9 has an enlarged reservoir portion 88 at the entrance portion of the deceleration channel 52. The embodiment of FIG. 9 can be used for food products that can benefit from a rapid expansion in the flow so as to produce foams with larger bubbles.

le;.5qAlthough a single deceleration channel may be used in embodiments of the invention, such as in FIG. 8, using a plurality of sub-deceleration channels allows the width of each to be narrower for the same cumulative cross-sectional expansion. The narrower width of the sub-channels allows a thinner foil 22 to be used, as the foil would have to be stiffer as each sub-channel or the single channel is made wider to prevent the deceleration channel from collapsing when the interior chamber 20 is pressurized. Many small sub-channels can be used, such as shown in FIG. 10, in which a plurality of sub-channels with substantially similar cross-sections are provided to increase the cross-sectional area of the conduit to slow the flow to the outlets 62. The foil used in this embodiment can be significantly thinner and weaker than in other embodiments, because the portions of the wall 91 between the grooves 92 that form the sub-deceleration channels act as multiple and close supports for the foil to resist the pressure in the internal cavity 20. FIG. 11 shows an embodiment with a deceleration channel 52 that splits into two sub-channels 96 at the exit of the restriction channel 50. Each sub-channel 96 splits into two further sub-channels 94 to provide a further increase in cross-sectional area prior to each outlet 62. FIG. 12 shows a conduit configuration that is similar to the one of FIG. 2, but with a restriction channel 50 that includes two sub-channels 108, and a deceleration channel 52 that includes two sub-channels 110 that extend from each restriction sub-channel 108. FIGS. 13 and 14 show alternative shapes of the deceleration channel 52.

Figure 15:
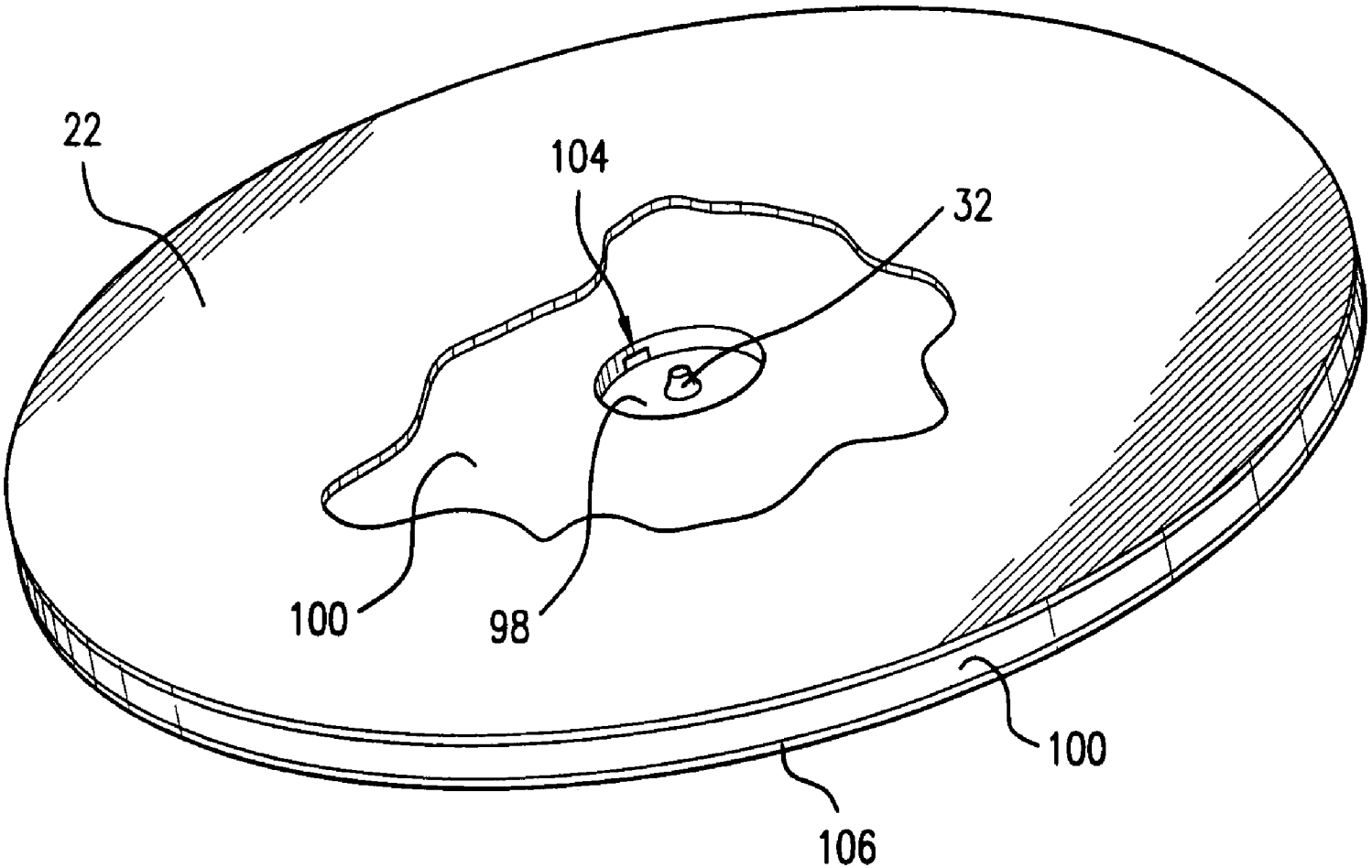
FIGS. 15 and 16 are top and bottom cut-away perspective views of another embodiment of a capsule lid.
Figure 16:
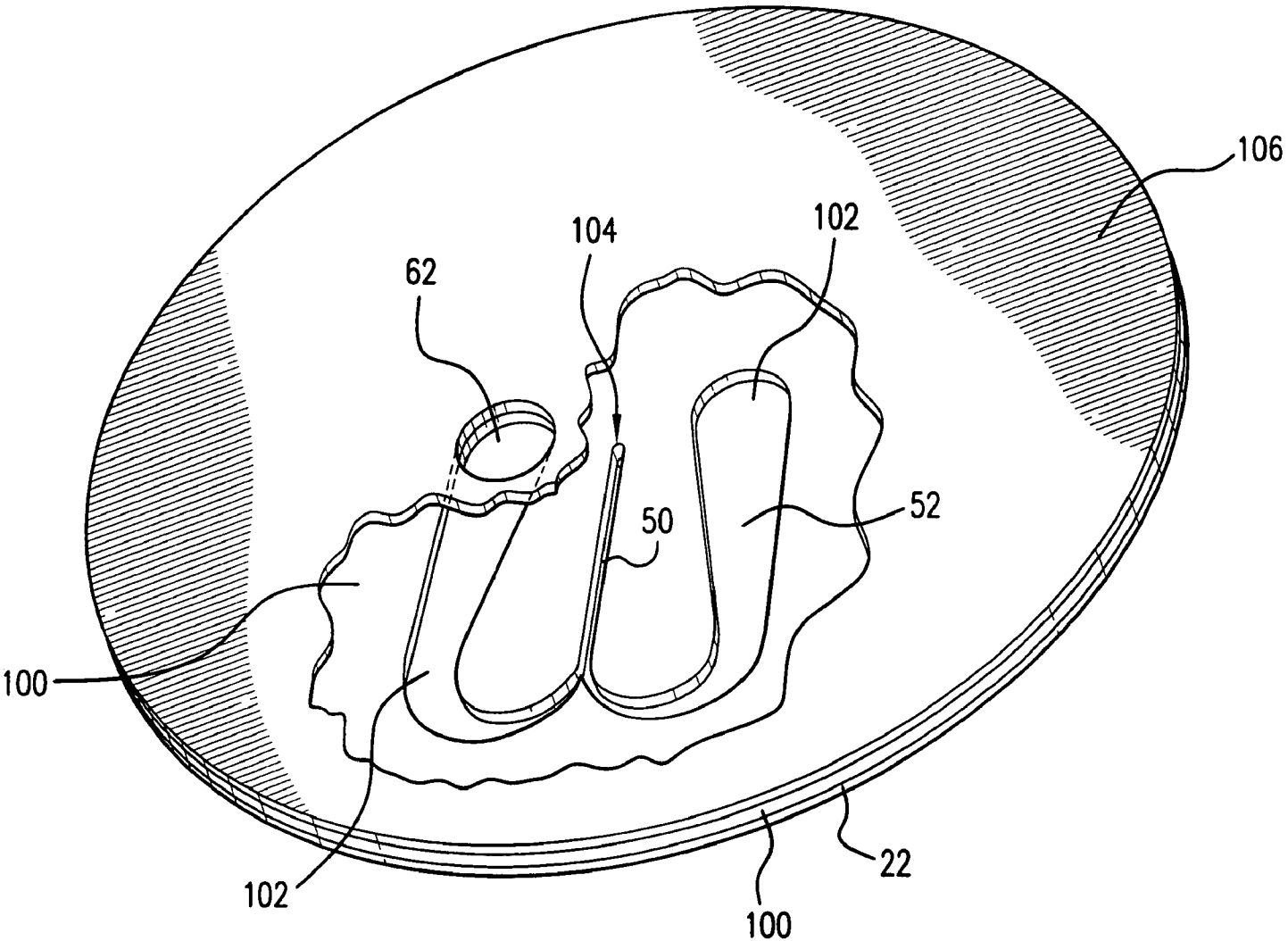

The embodiment of FIGS. 15 and 16 have a conduit entrance portion 98, including a foil piercing member 32, which are formed on an opposite side of lid wall 100 from the grooves 102 that define the restriction and deceleration channels 50,52. An opening 104 is defined between the enlarged entrance portion 98 and the restriction channel 50. An outer foil 106 is sealed to the wall 100 and around the grooves 102 to define the restriction and deceleration channels 50,52. Openings in the outer foil 106 define the outlets 62 of the foam conditioning conduit. As in the other embodiments, any of the foils or walls can be replaced with walls or foils as described above, and sealed to define the conditioning conduit in other embodiments. An outlet cover can be provided that can be opened before use, or automatically during use.

Figure 17:
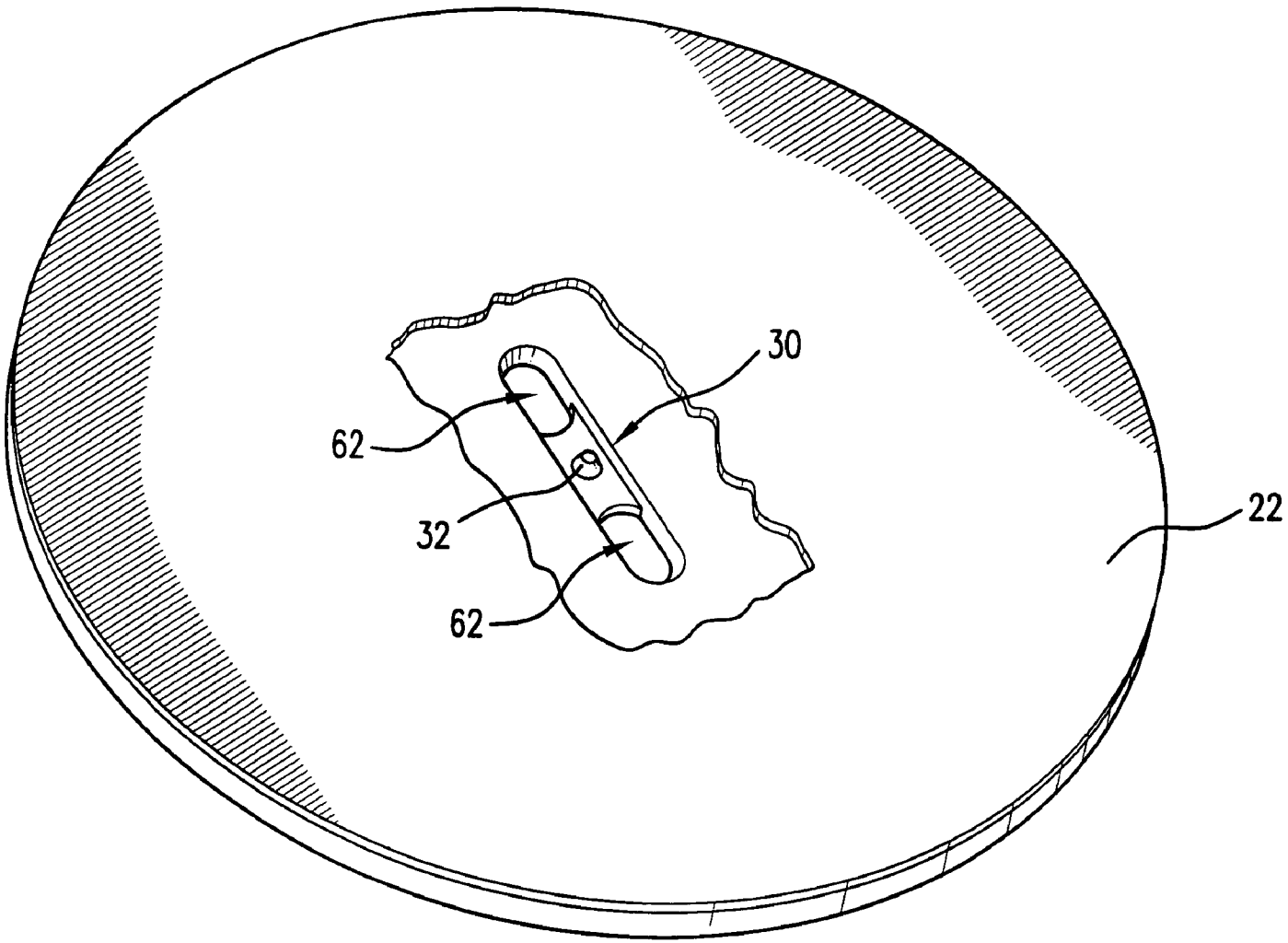
FIG. 17 is a top cut-away perspective view of an embodiment of a capsule lit that is self-opening and is free of a foam conditioning conduit.

FIG. 17 shows an embodiment of the invention with a conduit opening mechanism 30 with a foil puncturing member 32 protruding toward foil 22. When the piercing member 32 pierces the foil 22 upon reaching sufficient pressure within the interior chamber 20, a fluid pathway is opened directly to outlets 62, as no foam conditioning mechanism is present. This embodiment can be used where no foam conditioning is needed, for instance for tea beverages that do not require foam.

Typical initial flow rates of the fluid injected into the interior cavity 20 used in these embodiments are between 5 ml/s and 20 ml/s, and more preferably between about 8 ml/s and 12 ml/s. Higher or lower flow rates can be used in certain products. As the pressure builds in the capsule, the flow rate typically drops, such as to dispense the fluid food product from the outlets 62 at around 3-10 ml/s, and more preferably between about 4.5 ml/s and 6 ml/s. Typical pressures during the injection in the interior chamber 20 are around 4 to 20 bars. The pressure is decreased at the outlet, where it is typically between about 8 and 14 bars.

The preferred channel wall 24 is made of polypropylene of a thickness of between about 1.5 mm and 4 mm, and more preferably of around 2 mm. The preferred foil 22 of the embodiment of FIGS. 1-4 is between about 0.04 mm to 0.12 mm. Thicker foils can be used to withstand higher pressures and wider channels, and thinner foils can be used for lower pressures and narrower channels. The preferred materials for the foil and container portion are PE, EVOT, PET, aluminum, and a metalized polymer film. Other suitable materials may be used for different embodiments, however.

While illustrative embodiments of the invention are disclosed herein, it will be appreciated that numerous modifications and other embodiments may be devised by those skilled in the art. For example, in one embodiment, the foam conditioning conduit is provided as part of the extraction chamber, as separate piece from the capsule, and can also extend preferably along a substantially radial plane with respect to the axis of the outlets. Therefore, it will be understood that the appended claims are intended to cover all such modifications and embodiments that come within the spirit and scope of the present invention.

What is claimed is:

1. A device for preparation of a whipped food, comprising:

a container portion containing a food component and configured for receiving a fluid for mixing with the food component to produce a fluid mixture having a gas such that the fluid mixture includes gas bubbles;

a foam conditioning conduit associated with the container portion for receiving the fluid mixture therefrom with the gas bubbles entrained therein to produce a fluid food product, the conduit comprising:

a restriction channel associated with the container portion downstream thereof to receive the food product, the restriction channel being configured for conditioning the bubbles into a foam and having a cross-section sufficiently small and sufficient length for selectively feeding bubbles in the food product that are smaller than a preselected maximum bubble size, wherein the gas is introduced into the foam conditioning conduit upstream of the restriction channel, a deceleration channel in fluid communication with the restriction channel downstream thereof to receive the food product therefrom, the deceleration channel configured to substantially reduce the flow speed of the food product, and an outlet downstream of and in fluid communication with the deceleration channel to dispense the slowed flow of food product;

a package that comprises the container portion and the foam conditioning conduit, the package configured for operative association with an extraction device for feeding the fluid under pressure into the container portion; and a closure associated with the container portion for enclosing the food component therein, the foam conditioning conduit extending through the closure.

2. The device of claim 1, wherein the closure comprises at least two wall portions between which the channels are defined.

3. The device of claim 2, wherein a first one of the walls defines a groove, and a second one of walls comprises a foil sealed to the first wall for cooperatively defining at least a portion of the channels therebetween.

4. The device of claim 1 wherein:

the closure comprises a seal that seals the foam conditioning conduit from the food component in the container portion, the device further comprising an opening mechanism operably associated with the seal for opening the seal in response to an elevated fluid pressure within the container portion for fluidly communicating the container portion with the conditioning conduit for feeding the fluid mixture into the conduit.

5. The device of claim 4, wherein the opening mechanism comprises a piercing member disposed with respect to the seal such that, when the pressure reaches a predetermined value inside the container portion, the seal and piercing member are biased into a piercing association in which the piercing member pierces the seal to fluidly communicate the container portion with the foam conditioning conduit.

* * * * *